US007508317B2

(12) United States Patent
Telefont

(10) Patent No.: US 7,508,317 B2
(45) Date of Patent: Mar. 24, 2009

(54) CONTROL OF THE LUMINOUS INTENSITY OF POWER LEDS BY USING THE PHOTOELECTRIC EFFECT CHARACTERISTICS OF SAID POWER LEDS

(75) Inventor: Heinz Telefont, Krems-Egelsee (AT)

(73) Assignee: Alcatel, Paris (FR)

( * ) Notice: Subject to any disclaimer, the term of this patent is extended or adjusted under 35 U.S.C. 154(b) by 357 days.

(21) Appl. No.: 11/546,346

(22) Filed: Oct. 12, 2006

(65) Prior Publication Data

US 2008/0121761 A1 May 29, 2008

(30) Foreign Application Priority Data

Oct. 27, 2005 (EP) ..... 05292288

(51) Int. Cl.
*G08B 5/00* (2006.01)

(52) U.S. Cl. ..... 340/815.4; 315/149

(58) Field of Classification Search ..... 340/815.4, 340/815.45; 250/214 AL; 315/149, 150, 315/151, 155, 156, 157, 158; 362/257
See application file for complete search history.

(56) References Cited

U.S. PATENT DOCUMENTS 2,376,534 A * 5/1945 Field ..... 335/253
4,273,999 A * 6/1981 Pierpoint ..... 315/158
4,329,625 A 5/1982 Nishizawa et al.
4,536,847 A * 8/1985 Erickson et al. ..... 702/150
4,629,941 A * 12/1986 Ellis et al. ..... 315/153
5,471,052 A * 11/1995 Ryczek ..... 250/214 C
5,939,996 A * 8/1999 Kniveton et al. ..... 340/815.4
6,144,161 A * 11/2000 Kimmich et al. ..... 315/159
6,445,139 B1 * 9/2002 Marshall et al. ..... 315/149
6,495,964 B1 * 12/2002 Muthu et al. ..... 315/149
2004/0041702 A1 3/2004 Toulmin et al.
2005/0151665 A1 7/2005 Sommers et al.

FOREIGN PATENT DOCUMENTS

WO WO 99/20085 4/1999

* cited by examiner

*Primary Examiner*—John A Tweel, Jr.
(74) *Attorney, Agent, or Firm*—Sughrue Mion, PLLC

(57) ABSTRACT

A method for operating a signal lamp (1), in particular a railway signal lamp, wherein the signal lamp (1) comprises as its illuminant at least one light emitting diode (=LED) (2), and wherein the luminous intensity of the signal lamp (1) is adapted to the brightness of the surrounding, is characterized in that the at least one LED (2) is operated during first time intervals as the illuminant of the signal lamp (1), and during second time intervals, the at least one LED (2) is operated as a photo diode, that first and second time intervals alternate over time, in particular periodically, and that the output voltage of the LED (2) during the second time intervals is used to control the operating current of the at least one LED (2) during first time intervals. The inventive method does without a separate sensor, thus allowing the use of a corresponding signal lamp arrangement which is simple and inexpensive.

10 Claims, 1 Drawing Sheet

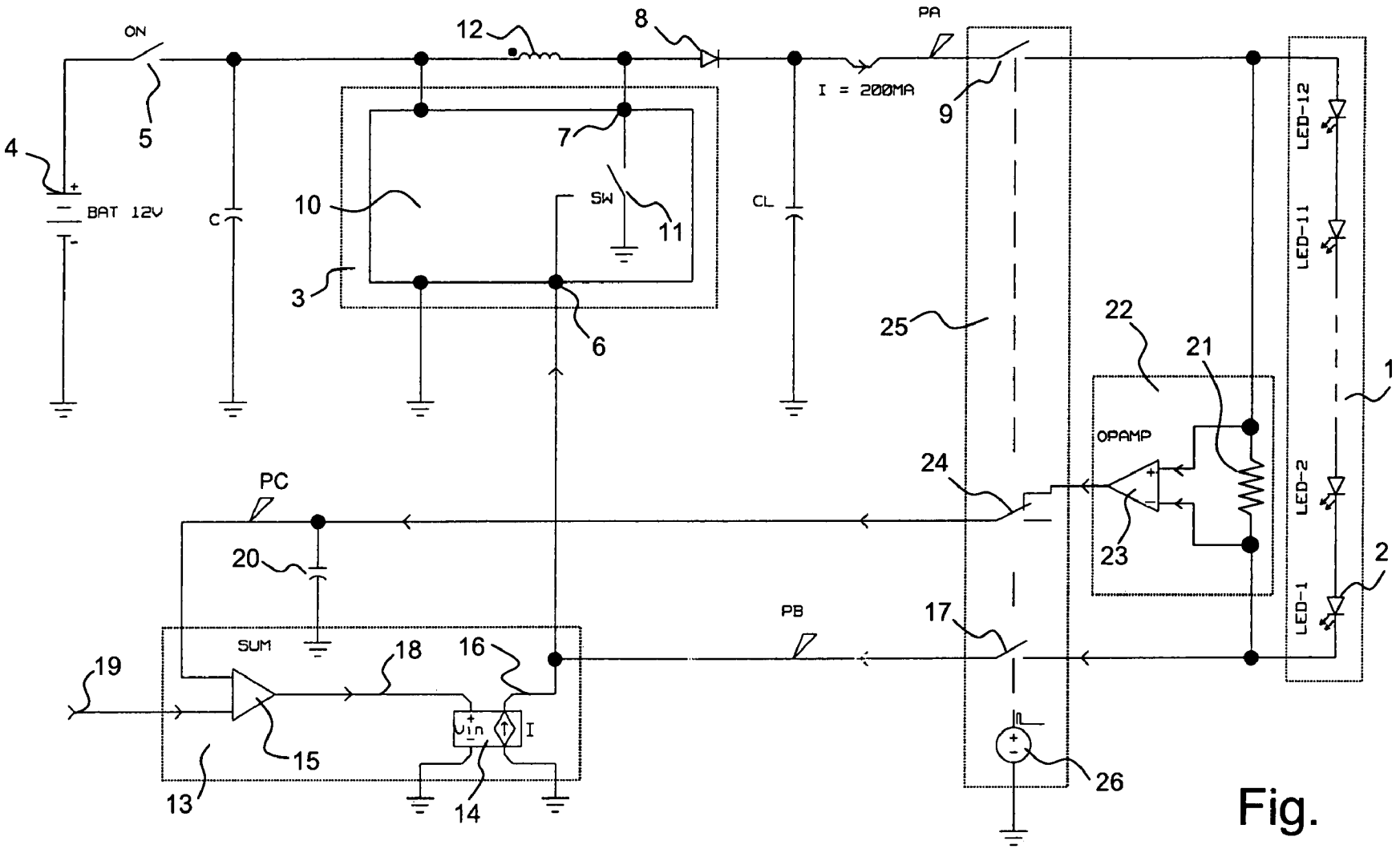
Fig.

CONTROL OF THE LUMINOUS INTENSITY OF POWER LEDS BY USING THE PHOTOELECTRIC EFFECT CHARACTERISTICS OF SAID POWER LEDS

BACKGROUND OF THE INVENTION

The invention is based on a priority application EP 05 292 288.7 which is hereby incorporated by reference.

The invention relates to method for operating a signal lamp, in particular a railway signal lamp, wherein the signal lamp comprises as its illuminant at least one light emitting diode (=LED), and wherein the luminous intensity of the signal lamp is adapted to the brightness of the surrounding.

Such a method, and a related signal lamp arrangement, is described in US2005/0151665A1.

Railway signal lamps are used, for example, to indicate the opening status of a railway track section to a train operator. Railway signal lamps of the state of the art use power light emitting diodes (=LEDs) as its illuminant. Power LEDs have proven to be more reliable and cost-effective than conventional light bulbs.

During daytime, the light of the railway signal lamp must be bright enough for the train operator to recognize the status of the signal lamp well before arriving at the signal lamp. During nighttime, however, the luminous intensity of the signal lamp must be low enough so the train operator is not dazzled. This means that the luminous intensity of a railway signal lamp should be adapted to the brightness of the surroundings.

US2005/0151665A1 describes a signaling control device apparatus for LED traffic signalling applications. A sensor is used to determine the light load in the surroundings, and its signal is used to adapt the LED current.

The separate sensor makes the signal lamp arrangement, and in particular the electric circuit, rather complex and expensive.

SUMMARY OF THE INVENTION

It is therefore the object of the invention to provide a method for adapting the luminous intensity of an LED based signal lamp that may do without a separate sensor, thus making the corresponding signal lamp arrangement simpler and less expensive.

This object is achieved, in accordance with the invention, by a method as described in the beginning, characterized in that the at least one LED is operated during first time intervals as the illuminant of the signal lamp, and during second time intervals, the at least one LED is operated as a photo diode, that first and second time intervals alternate over time, in particular periodically, and that the output voltage of the LED during the second time intervals is used to control the operating current of the at least one LED during first time intervals.

The at least one LED, typically a few power LEDs connected in series and provided with optical devices such as mirrors and lenses, may be used as a photo diode (or a photo detector). When the signal lamp is scheduled to shine (i.e. the signal lamp is switched on as a whole), first and second time intervals alternate. First time intervals are typically much longer than second time intervals, and second time intervals are typically rather short, such as a fraction of a second, compared with first time intervals. During first time intervals, the at least one LED emits light, whereas during second time intervals, no light is emitted by the LED at all. In particular, during second time intervals, the at least one LED should be disconnected from any power source or storing capacity or the like. During those second time intervals, the light of the surroundings (e.g. daylight) falls onto the at least one LED and causes a voltage which is roughly proportional to the brightness of the surroundings. This voltage is then used to adapt the operating current (and thus the luminous intensity) of the LED during first time intervals. By this means, it is not necessary to use a separate, dedicated sensor or photo diode in order to determine the brightness of the surrounding.

A preferred variant of the inventive method is characterized in that a low output voltage of the LED during the second time intervals, i.e. a dark surrounding, is used to establish a low operating current of the at least one LED during first time intervals, i.e. a low luminous intensity of the signal lamp, and that a high output voltage of the LED during the second time intervals, i.e. a bright surrounding, is used to establish a high operating current of the at least one LED during first time intervals, i.e. a high luminous intensity of the signal lamp. This variant increases the contrast of the signal lamp during daytime, and keeps a train operator from being dazzled at night.

In an advantageous variant of the inventive method, the distribution of first and second time intervals is chosen such that for a human observer, the signal lamp appears to be constantly operating, in particular wherein the first time intervals are at least 1.0 seconds long, and the second time intervals are at maximum 0.001 seconds long. This variant keeps a train operator from being confused by a flickering signal lamp, and second time intervals cannot be mistaken for periods when the signal lamp is supposed not to shine.

Also within the scope of the current invention is a signal lamp arrangement, in particular a railway signal lamp arrangement, with a signal lamp comprising at least one light emitting diode as its illuminant, and with an electronic circuit for operating the signal lamp, characterized in that the electronic circuit comprises

- a supply means for supplying the at least one LED with operating current,
- a tapping means for tapping the LED voltage of the at least one LED,
- a comparison means for comparing the LED voltage to a reference voltage, wherein the comparison means is connected to the supply means for controlling the supply means, and a switching means for switching the electronic circuit from a first state into a second state and vice versa, wherein in the first state, the supply means is connected to the at least one LED, and the comparison means is disconnected from the at least one LED, in particular wherein the tapping means is disconnected from the comparison means, and wherein in the second state, the supply means is disconnected from the at least one LED, and the comparison means is connected to the at least one LED, in particular wherein the tapping means is connected to the comparison means.

The inventive signal lamp arrangement does without a separate sensor, thus keeping its design simple and cost-effective. In particular, there is no separate sensor to maintain. Moreover, the brightness of the surroundings is automatically measured exactly where appropriate in order to optimise the contrast of the signal lamp. Of course, the inventive signal lamp arrangement may be (and is intended to be) operated with an the above described inventive method. First time intervals correspond to the first state of the electronic circuit, and second time intervals correspond to the second state.

In a preferred embodiment of the inventive signal lamp arrangement, the tapping means comprises a measuring resistance and an operational amplifier tapping the voltage of the measuring resistance. The current produced by the LEDs during second time intervals causes a voltage over the measuring resistance. This voltage is amplified with the operational amplifier in order to simplify the further processing, in particular the comparison in the comparison means.

In another preferred embodiment, the input of the comparison means is connected to a capacitor for smoothing the LED voltage during a switching cycle of the switching means. When an operational amplifier in the tapping means is used, the amplified LED voltage is smoothed. With the storing capacitor, the sample-hold procedure at the comparison means may be applied. The voltage at the input of the comparison means then is rather constant over time (in particular over a full switching cycle of the switching means including a first and a second time interval), with a quick update during any second time interval. The smoothing keeps the operating current of the LED (and thus its luminous intensity) basically constant during a first time interval.

A preferred embodiment is characterized in that the comparison means comprises an operational amplifier, in particular a summing amplifier, connected to the voltage input of a voltage controlled current supply. The operational amplifier may transform even small changes in the (amplified) LED voltage into an intermediate signal suitable for use in the voltage controlled current supply (=VCCS). The VCCS limits the LED current during first time intervals. The VCCS, in particular in cooperation with a push-pullup-controller of the supply means, has a rather small power consumption.

Further preferred is an embodiment of the inventive signal lamp arrangement characterized in that the supply means is connected to a DC voltage supply, and that the supply means comprises a control input and a voltage output, wherein the voltage at the control input controls the voltage at the voltage output, in particular wherein the supply means comprises a push-pullup-controller with a voltage converter. The voltage at the control input is provided by the comparison means. The power supply of the LED is done via the voltage output of the supply means. The push-pullup-controller and the voltage converter are well suited for setting a voltage to the signal lamp, in particular a higher voltage than provided by the DC voltage supply (battery voltage). As long as the voltage at the control input is below a critical value, the voltage at the voltage output is increased, whereas the voltage at the voltage output is held constant at a maximum level once the voltage at the control input has reached the critical value.

In a preferred embodiment the switching means comprises an impulse generator and a plurality of switches, wherein the impulse generator controls the positions of the switches. With this embodiment, a quick change of state of the electrical circuit may be realised, in particular by switching all switches simultaneously.

Particularly preferred is an embodiment of the inventive signal lamp arrangement wherein the signal lamp comprises a plurality of LEDs connected in series. The LEDs are typically power LEDs to provide enough luminous intensity for railway or other traffic applications. When connecting the LEDs in series, higher voltages can be used, and more luminous intensity may be generated with the same electronics.

Further advantages can be extracted from the description and the enclosed drawing. The features mentioned above and below can be used in accordance with the invention either individually or collectively in any combination. The embodiments mentioned are not to be understood as exhaustive enumeration but rather have exemplary character for the description of the invention.

BRIEF DESCRIPTION OF THE DRAWINGS

The invention is shown in the drawing. The only FIGURE shows a schematic circuit diagram of an inventive signal lamp arrangement for use with the inventive method.

The inventive signal lamp arrangement comprises a signal lamp 1, which in turn comprises twelve power LEDs 2 connected in series. The LEDs 2 are powered via a supply means 3. This supply means 3 is connected to a DC voltage supply 4 providing a battery voltage of 12V, via a main switch 5. With the main switch 5, the signal lamp 1 can be turned on and off.

The supply means 3 comprises a control input 6 and a voltage output 7, wherein the voltage output 7 is connected to the signal lamp 1 via a diode 8 and a first switch 9. In the embodiment shown, the supply means 3 consists of a push-pullup-controller 10 with a voltage converter 11. The voltage output 7 is also connected to the DC voltage supply 4 via a choking coil 12.

The control input 6 of the supply means 3 is connected to a comparison means 13. In the embodiment shown, the comparison means 13 comprises a voltage controlled current source (VCCS) 14 and a summing amplifier 15, and the control input 6 is connected to the current output 16 of the VCCS 14. Also connected to the current output 16 is the signal lamp 1 via a switch 17.

The VCCS 14 determines and limits the current through the signal lamp 1 during first time intervals. In the embodiment shown, at daytime conditions and during first time intervals (when switches 9 and 17 are closed and the LEDs 2 glow), a current of about 200 mA flows through the signal lamp 1. At position PA, near switch 9, a voltage of about 35V is present, whereas at position PB, near switch 17, a voltage of about 2V is present. The current value set by the VCCS 14 determines the luminous intensity of the LEDs 2 during first time intervals.

The voltage at position PA is set by the push-pullup-controller 10 and the voltage converter 11 of the supply means 3. When the voltage at position PB (which is identical to the voltage at the control input 6) is below a critical value, here 2V, the voltage at the voltage output 7 (which is almost identical to the voltage at position PA) is increased. When the voltage at PB is at 2V, the voltage at voltage output 7 is held at a constant value, here at 35V, that is appropriate for the type and number of LEDs 2. When the voltage at PB is above 2V, the voltage at the voltage output 7 is lowered. In other words, the supply means 3 increases the voltage at position PA until the LEDs 2 let pass the desired current. In this way, an appropriate voltage for the signal lamp 1 is obtained.

The voltage at position PB is dependent from the current value set at the VCCS 14. The critical value (here 2V) is obtained when the desired current flows through the signal lamp 1 and, identically, through the VCCS 14 at its current output 16. The current value of the VCCS 14 is set by a voltage present at a voltage input 18 of the VCCS 14. So in order to adjust the luminous intensity of the LEDs 2, the voltage at voltage input 18 must be altered.

The voltage at voltage input 18 is provided by the summing amplifier 15 which adds up a reference voltage present at a reference input 19 and a stored voltage (present at position PC) of a capacitor 20. As a central idea of the invention, the voltage at position PC is determined by the brightness in the surrounding of the LEDs 2.

This is achieved by operating the LEDs 2 during second time intervals as photo diodes. During those second time intervals, the switches 9, 17 are open, so that the LEDs 2 do not get any battery power, and so do not glow any more. Instead, incoming light of the surrounding of the LEDs causes a voltage over the LEDs and a weak current through a measuring resistance 21 which is connected in series with the LEDs. The measuring resistance 21 has a typical value of 10 MOhms. It is part of a tapping means 22, which further comprises an operational amplifier 23 connected in parallel to the measuring resistance 21. The operational amplifier 23 generates an amplified LED voltage out of the LED voltage present at the measuring resistance 21 during second time intervals. This amplified LED voltage loads during second time intervals via a closed switch 24 the capacitor 20, i.e. the voltage at the capacitor 20 is updated during second time intervals. The capacity of the capacitor 20 is large enough so the voltage at position PC falls only insignificantly between two updates.

The voltage at the measuring resistance 21 during second time intervals is a function of the brightness in the surrounding of the LEDs 2. Thus, the voltage at the capacitor 20 and at position PC is also a function of said brightness.

The electrical circuit can be switched between a first state, realized during the time of first time intervals, and a second state, realized during the time of second time intervals, by a switching means 25. The switching means 25 comprises the switches 9, 17 and 24, and an impulse generator 26. The impulse generator 26 controls the positions of the switches 9, 17, 24.

For the first state, when the LEDs 2 glow, switches 9, 17 are closed, thus connecting the signal lamp 1 to the supply means 3 powering the LEDs 2, and switch 24 is open. The switch 24 then disconnects the supply means 3, the LEDs 2 and the tapping means 22 from the capacitor 20 and the comparison means 13.

For the second state, when the LEDs are dark and operate as photo detectors, switches 9, 17 are open in order to cut the signal lamp 1 from the battery power, and switch 24 is closed in order to provide the capacitor 20 and thus the comparison means 13 with the amplified LED voltage.

When the surrounding is bright, the LEDs provide a high voltage at the measuring resistance 21 during second time intervals, and a high voltage at position PC is obtained at all times (first and second time intervals, since the capacitor 20 smoothes the voltage over a switching cycle of the switching means 25). Then also a high voltage is provided at the voltage input 18 of the VCCS 14, resulting in a high current through the LEDs 2 during first time intervals. The LEDs 2 produce much light then, and the signal lamp is well visible despite the bright surrounding.

When the surrounding is dark, the LEDs 2 provide only a small or no voltage at the measuring resistance 21 during second time intervals. As a result, voltages at position PC and at the voltage input 18 are low during all times, and a low current is set at the VCCS 14 for the LEDs 2 during first time intervals. The LEDs produce only low-light then, and the signal lamp will not dazzle a viewer such as a train operator or a car driver.

Note that a switching cycle of the switching means is typically on the order of seconds (e.g. first time intervals of 1 s, and second time intervals of 1 ms, totaling to a switching cycle of 1.001 s), whereas significant changes in the brightness of the surrounding, such as between day and night or due to a weather change, are on the order of typically several minutes. The capacity of the capacitor 20 is chosen such that its voltage (at position PC) is stable over a switching cycle, but variable with expected brightness changes of the surrounding.

By changing the reference voltage at reference input 19, the basic brightness of the signal lamp 1 can be adjusted. In the embodiment shown, the reference voltage and the voltage at position PC are added in the summing amplifier 15. The reference voltage then determines the minimum luminous intensity of the LEDs 2, i.e. their luminous intensity in a completely dark surrounding. The ratio between maximum and minimum luminous intensity is determined by the amplification factor of the operational amplifier 23 of the tapping means 22. For typical day/night adaptation in railway applications, the inventive signal lamp arrangement is adapted to provide a ratio of minimum to maximum luminous intensity of the signal lamp of 0.1 or lower.

The inventive signal lamp arrangement allows to establish a broad range of luminous intensities. The electric circuit may easily be adapted to different types of LEDs. The voltage at position PC ("brightness signal") may be used to detect a failure of an LED by a reduced voltage generation during second time intervals (i.e. during use as photo detectors). The ratio of first and second time intervals ("pulse-break-ratio") may be chosen in a wide range. Note that the inventive signal lamp arrangement and the corresponding method is not limited to railway applications, but may be useful for other applications, such as traffic lights, too.

The invention claimed is:

1. Method for operating a signal lamp, in particular a railway signal lamp, wherein the signal lamp comprises as its illuminant at least one light emitting diode (=LED), and wherein the luminous intensity of the signal lamp is adapted to the brightness of the surrounding, wherein at least one LED is operated during first time intervals as the illuminant of the signal lamp, and during second time intervals, the at least one LED is operated as a photo diode, that first and second time intervals alternate over time, in particular periodically, and that the output voltage of the LED during the second time intervals is used to control the operating current of the at least one LED during first time intervals.

2. Method according to claim 1, wherein a low output voltage of the LED during the second time intervals, i.e. a dark surrounding, is used to establish a low operating current of the at least one LED during first time intervals, i.e. a low luminous intensity of the signal lamp, and that a high output voltage of the LED during the second time intervals, i.e. a bright surrounding, is used to establish a high operating current of the at least one LED during first time intervals, i.e. a high luminous intensity of the signal lamp.

3. Method according to claim 1, wherein the distribution of first and second time intervals is chosen such that for a human observer, the signal lamp appears to be constantly operating, in particular wherein the first time intervals are at least 1.0 seconds long, and the second time intervals are at maximum 0.001 seconds long.

4. Signal lamp arrangement, in particular railway signal lamp arrangement, with a signal lamp comprising at least one light emitting diode (=LED) as its illuminant, and with an electronic circuit for operating the signal lamp, wherein that the electronic circuit comprises a supply means for supplying the at least one LED with operating current, a tapping means for tapping the LED voltage of the at least one LED, a comparison means for comparing the LED voltage to a reference voltage, wherein the comparison means is connected to the supply means for controlling the supply means, and a switching means for switching the electronic circuit from a first state into a second state and vice versa, wherein in the first state, the supply means is connected to the at least one LED, and the comparison means is disconnected form the at least one LED, in particular wherein the tapping means is disconnected from the comparison means, and wherein in the second state, the supply means is disconnected from the at least one LED, and the comparison means is connected to the at least one LED, in particular wherein the tapping means is connected to the comparison means.

5. Signal lamp arrangement according to claim 4, wherein the tapping means comprises a measuring resistance and an operational amplifier tapping the voltage of the measuring resistance.

6. Signal lamp arrangement according to claim 4, wherein the input of the comparison means is connected to a capacitor for smoothing the LED voltage during a switching cycle of the switching means.

7. Signal lamp arrangement according to claim 4, wherein the comparison means comprises an operational amplifier, in particular a summing amplifier, connected to the voltage input of a voltage controlled current supply.

8. Signal lamp arrangement according to claim 4, wherein the supply means is connected to a DC voltage supply, and that the supply means comprises a control input and a voltage output, wherein the voltage at the control input controls the voltage at the voltage output, in particular wherein the supply means comprises a push-pullup-controller with a voltage converter.

9. Signal lamp arrangement according to claim 4, wherein the switching means comprises an impulse generator and a plurality of switches, wherein the impulse generator controls the positions of the switches.

10. Signal lamp arrangement according to claim 4, wherein the signal lamp comprises a plurality of LEDs connected in series.

* * * * *